US006714110B2

(12) United States Patent
Siu

(10) Patent No.: US 6,714,110 B2
(45) Date of Patent: Mar. 30, 2004

(54) SLEEVED CASE DESIGN FOR ADJUSTABLY INCREASING CREEPAGE DISTANCE

(76) Inventor: Paul Siu, 499 Kings Road, 15$^{th}$ Floor, North Point (HK)

( * ) Notice: Subject to any disclaimer, the term of this patent is extended or adjusted under 35 U.S.C. 154(b) by 271 days.

(21) Appl. No.: 09/950,868

(22) Filed: Sep. 12, 2001

(65) Prior Publication Data

US 2002/0035776 A1 Mar. 28, 2002

Related U.S. Application Data

(60) Provisional application No. 60/234,267, filed on Sep. 21, 2000.

(51) Int. Cl.$^{7}$ ..... H01F 27/02
(52) U.S. Cl. ..... 336/96; 336/90; 336/229
(58) Field of Search ..... 336/65, 90, 96, 336/98, 229; 174/50, 52.2, 52.4

(56) References Cited

U.S. PATENT DOCUMENTS 3,905,000 A 9/1975 Walter
3,908,264 A 9/1975 Friberg et al.
4,263,479 A * 4/1981 Lange et al. ..... 178/46
4,267,404 A * 5/1981 Rohde ..... 178/46
4,602,122 A * 7/1986 Lint ..... 174/52.1
5,479,146 A 12/1995 Herbert
5,519,581 A 5/1996 Liepe
6,225,560 B1 * 5/2001 Machado ..... 174/52.2

FOREIGN PATENT DOCUMENTS

JP 01-119007 * 5/1989

* cited by examiner

*Primary Examiner*—Tuyen T. Nguyen
(74) *Attorney, Agent, or Firm*—Witham, Curtis and Christofferson, PC

(57) ABSTRACT

A sleeved case design which provides variable increases in creepage distance for toroidal inductors mounted in a case for automatic insertion into circuit boards by means of sleeves protruding upward into the case from mounting holes in the case floor. A sleeve surrounds the hole so that the shortest distance from the case floor at the point of closest contact with the inductor along a case surface to the hole is up the outside of the sleeve and down the inside of the sleeve. The wire leads of the secondary for the inductor are routed through the sleeves.

8 Claims, 4 Drawing Sheets

SLEEVED CASE DESIGN FOR ADJUSTABLY INCREASING CREEPAGE DISTANCE

This patent application claims priority from U.S. provisional application No. 60/234,267 entitled "Sleeved case design for adjustably increasing creepage distance" filed on Sep. 21, 2000.

BACKGROUND OF THE INVENTION

1. Field of the Invention

The present invention generally relates to electrical component packaging and particularly to cases for toroidal inductors which are suitable for automatic insertion on circuit boards.

2. Background Description

Circuit board fabrication is often accomplished with the aid of automatic insertion equipment. This equipment automatically handles electrical components and inserts the component leads into holes in the circuit board. In order that electrical components, such as a wire-wound magnetic core, can be inserted on a circuit board with such equipment, the component is often placed on a supporting structure or "case", that enables automatic handling. A typical existing case design for electrical components includes an open box with holes in the bottom for the wire leads. Once the leads are threaded through the holes, an adhesive or potting compound is used to secure the component to the case. Later the leads are sheared to length.

As technology advances, electrical components become smaller and are packaged more closely. However, it remains necessary to meet safety and operating requirements. As electrical components become smaller and are packaged more closely, the distance between conductors grows smaller and electrical effects which were not significant for larger distances become limiting factors in the design and packaging of electrical components.

Of particular concern are toroidal transformers for mounting on printed circuit boards, because of their relative bulk and higher voltages. An increasingly significant factor affecting the design of case mounted toroidal transformers is "creepage distance," which is the shortest distance through air along the surface of an insulating material between two conductive parts. Minimum creepage distance requirements increase where air pollution generates high and persistent conductivity caused, for instance, by conductive dust or moisture.

To achieve minimum creepage distance requirements manufacturers have several options under current state of the art. First, they may raise the core to provide the required distance between windings and the terminations. Second, they may terminate the wires outside the case at a point some distance from where the wires exit the case. However, raising the core increases component height, which defeats an advantage of a smaller core. Furthermore, if the wires are terminated outside the case the burden of satisfying minimum creepage distance requirements passes to the circuit board designer who must pay special attention to the layout of the printed circuit board and the location of adjacent components.

What is needed is a way to provide minimum creepage distance without either raising the core or terminating wire leads some distance from where the wire exits the casing. Furthermore, it would be advantageous to provide an approach which is flexible enough to accommodate a wide range of creepage distance requirements.

SUMMARY OF THE INVENTION

It is therefore an object of the present invention to provide a transformer casing design which increases the creepage distance.

It is a further object of the invention to provide a transformer casing design which allows the creepage distance to be varied to accommodate different limits in minimum creepage distance, and to do so without changing the size, footprint or pin placements of the case.

Another object of the invention is to have a casing design for minimum creepage distance which allows for smaller core sizes.

It is also an object of the invention to provide a casing design which does not require raising the case in order to achieve minimum creepage distance requirements.

A further object of the invention is to provide a casing design which does not require wire termination some distance from where the wire leaves the case in order to achieve minimum creepage distance requirements.

Yet another object of the invention is a casing design that is inexpensive to manufacture.

The present invention provides a sleeved case design wherein variable creepage distance is provided by sleeves protruding upward into the case and through which wire leads egress from the case at a mounting hole. This does not require raising the core or terminating the wire some distance from the mounting hole. This sleeved case can be built with different sleeve heights to meet different safety distance requirements. The sleeve allows production of a current sense device which is much smaller in physical size than is otherwise acceptable, much less expensive to manufacture, and still meet the creepage and clearance dimensions required by the Safety Agencies.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
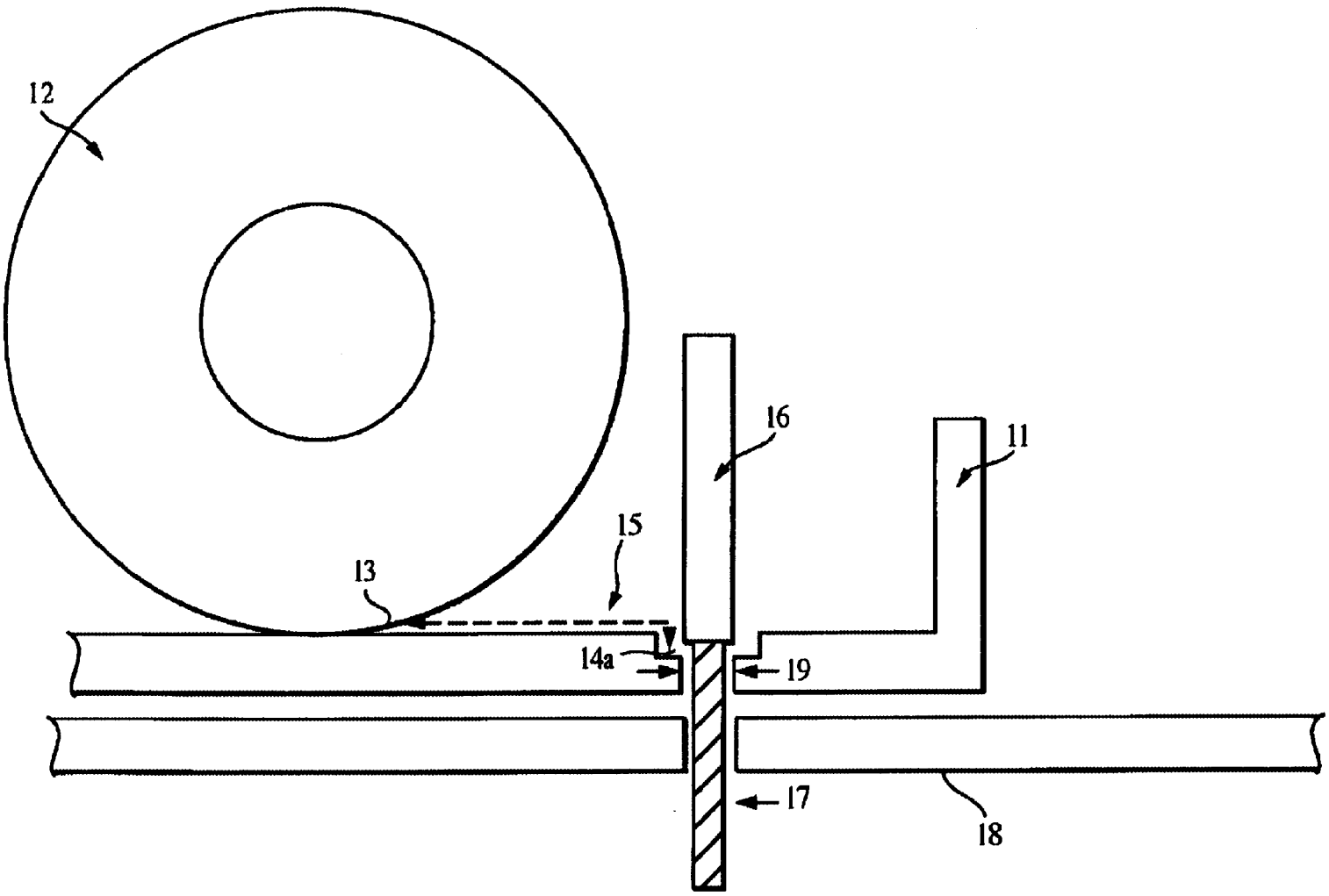
FIG. 1a PRIOR ART
FIGS. 1*a*, 1*b* and 1*c* are cutaway views of a core and case mounting in the prior art showing creepage distance between the core and the conductive lead in a flush mount (1*a*), an elevated mount (1*b*) and a mount where the leads are terminated some distance from the mounting hole where the wire leaves the case (1*c*).

Referring now to the drawings, and more particularly to FIG. 1*a*, there is shown a cutaway view of a casing 11 within which there is a core 12 (windings not shown). Secondary windings (not shown) on the core are of insulated wire. This wire exits the casing 11 through a hole in the casing 19, and during assembly is inserted through a corresponding hole in the printed circuit board 18. At the point of exit 14*a* the insulation 16 on the wire is stripped, leaving bare conductor lead 17 for electrical connection to the printed circuit board 18.

The creepage distance 15 is the shortest distance between the core 12 along the surface of the insulating material that composes the casing 11, from the point 13 where the core is closest to the insulating material to the point 14*a* at which the insulation 16 has been stripped leaving bare conductor lead 17. In the configuration shown in FIG. 1*a*, the creepage distance for cores in modern usage is increasingly insufficient to meet safety requirements.

To meet the safety creepage distance requirement for UL, VDE and IEC, manufacturers have several options under current state of the art. First, they may raise the core to provide the required distance between windings and the terminations. Second, they may provide additional distance between windings and the terminations by terminating the wires some distance from the point where the wire leaves the case. However, raising the core increases component height. Furthermore, if the wires are terminated some distance from the point where the wire leaves the case (in order to ensure enough creepage distance) the circuit board designer must pay special attention to the layout of the printed circuit board.

Figure 1B:
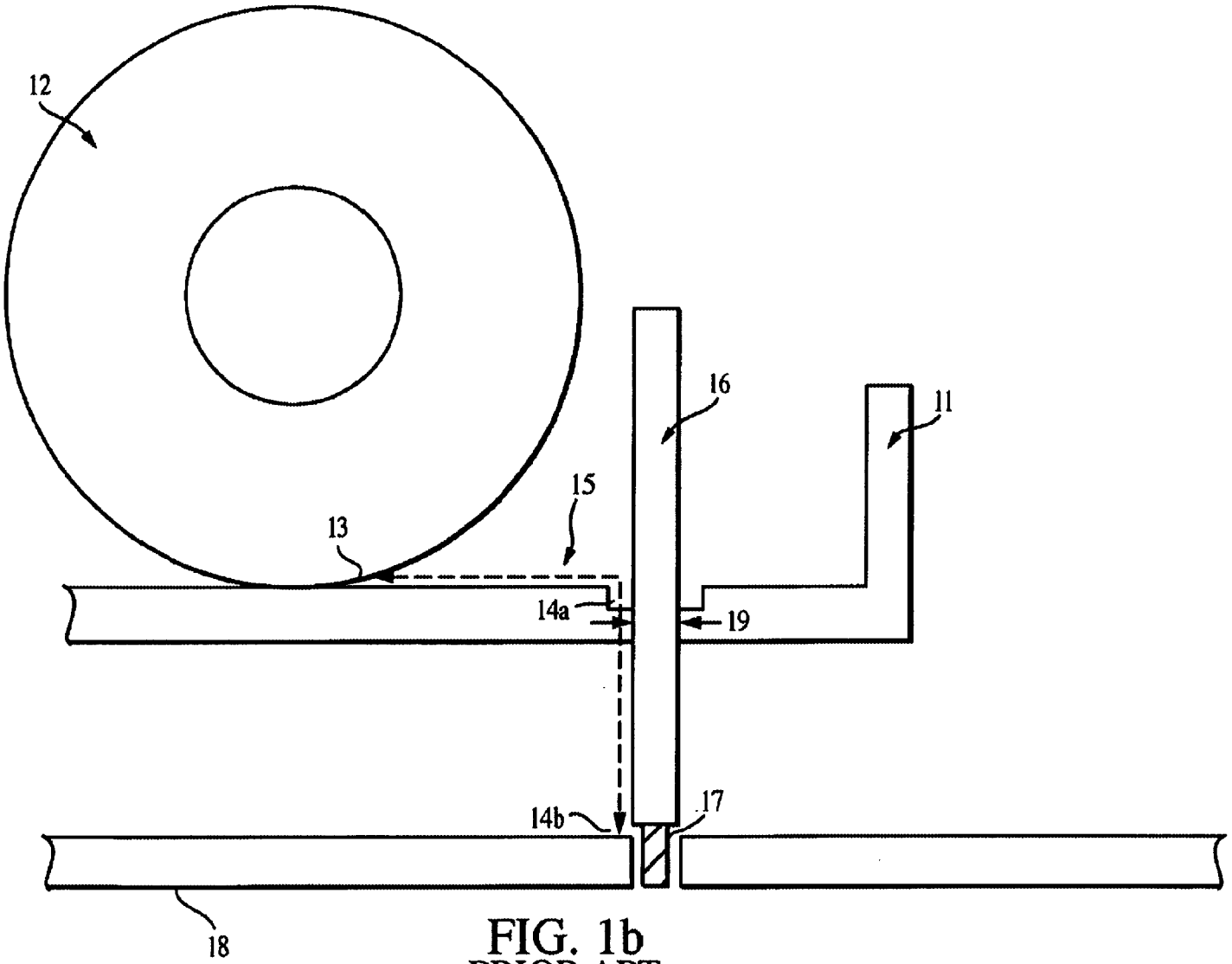
FIG. 1b PRIOR ART

As shown in FIG. 1*b*, the creepage distance may be increased by elevating the casing 11 above the printed circuit board 18, allowing additional distance along insulator 16 (from 14*a* to 14*b*) to the point 14*b* at which the insulation 16 is stripped leaving bare conductor lead 17.

Figure 1C:
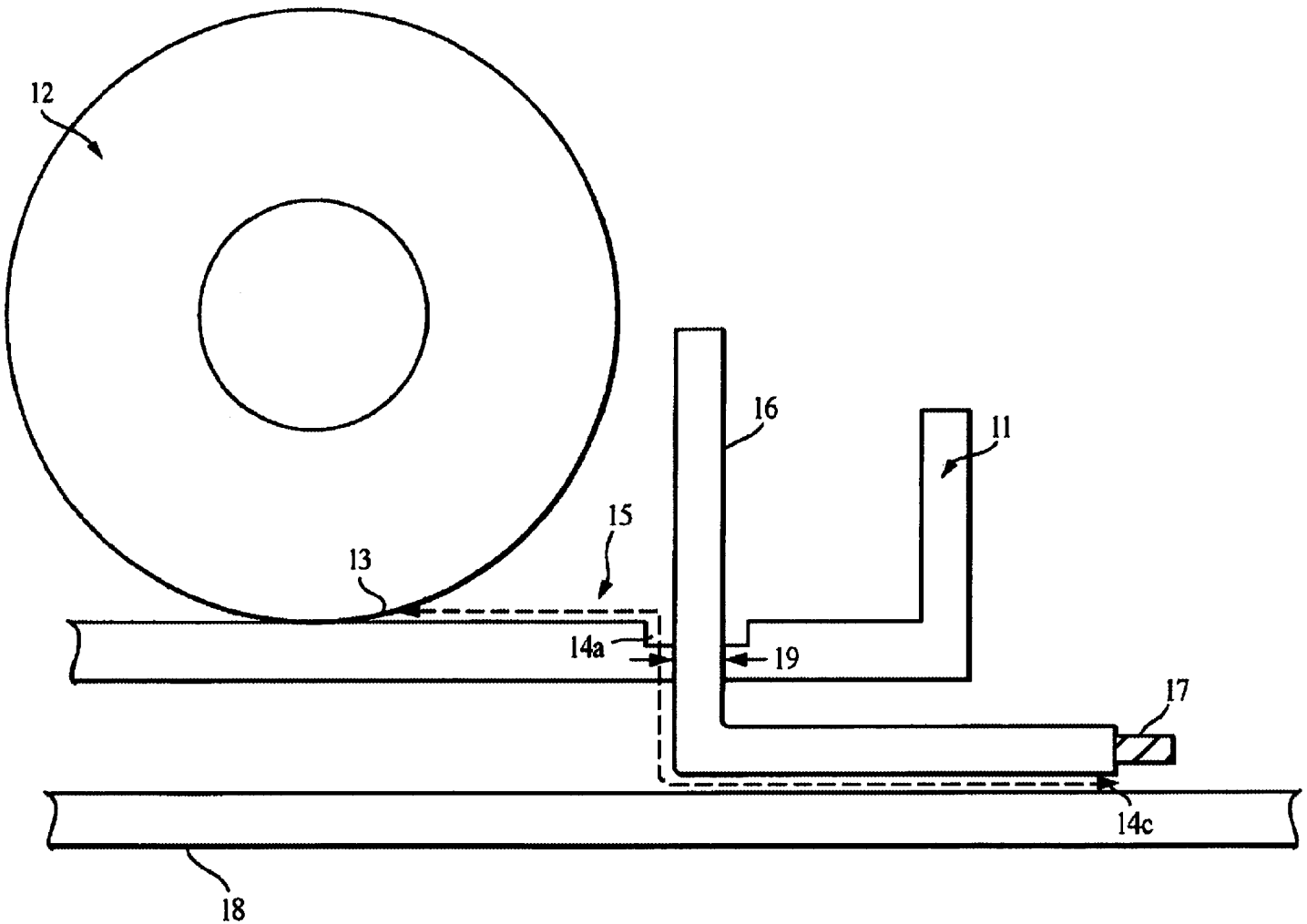
FIG. 1c PRIOR ART

Alternatively in the prior art, the creepage distance may also be increased, as shown in FIG. 1*c*, by extending the wire beyond the exit hole 19 before terminating at a point 14*c* at which point the insulation 16 is stripped, allowing additional distance along insulator 16 (from 14*a* to 14*c*) before coming to bare conductor lead 17.

Figure 2:
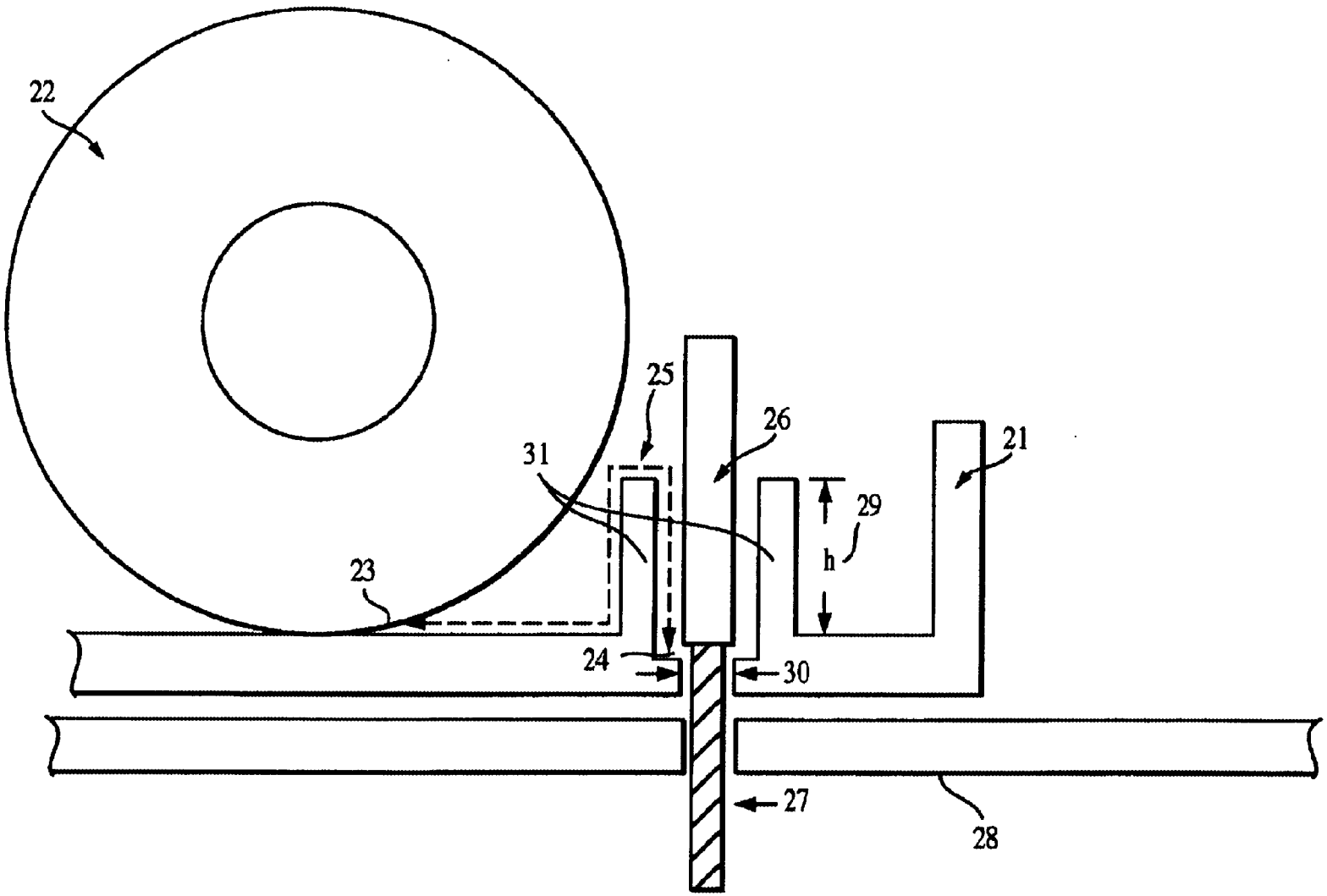
FIG. 2 is a cutaway view of a core and a sleeved casing according to the present invention showing creepage distance between the core (where it most closely abuts the casing insulation) and the conductive lead (where the wire is stripped as it exits the mounting hole), there being a vertical sleeve extending up around the mounting hole so that the shortest path to the mounting hole along an insulating surface necessarily goes over the top of the sleeve and down the interior of the sleeve to the mounting hole. By varying the height of the sleeve it is possible to satisfy a range of minimum creepage distance requirements using the same casing construction and without changing the placement of the casing on the circuit board or the physical and electrical mounting procedures.

Now turning to FIG. 2, there is shown a cutaway view of the sleeve 31, through which the wire is inserted to go through the hole 30 exiting the casing 21. The creepage distance 25 from the core 22 now goes along the surface of the insulating material that composes the casing 21, from the point 23 (where the core is closest to the insulating material of the casing) to the point 24 where the insulation is stripped from the conductor 26 leaving bare conductor lead 27. This distance is increased by twice the height 29 of the sleeve 31, because the path along the surface must detour up and then down along the sleeve.

The sleeved case design provides creepage distance by means of vertical sleeves built into the case. A sleeve surrounds the hole so that the shortest distance from the case floor along a case surface to the hole is up the outside of the sleeve and down the inside of the sleve to the hole. The "creepage distance" is increased by the amount of traverse up and down the sleeve. This technique for increasing "creepage distance" does not require raising the core, and avoids the additional circuit board design concerns required where the added creepage clearance is provided by terminating the wire some distance from where the wire leaves the case.

In the best most of implementation of the invention the sleeve is a simple hollow cylinder vertically aligned over the mounting hole 30 constructed seamlessly as part of the casing 21, so that the shortest path from inside the casing along the surface of the insulating material of the casing in order to exit the mounting hole 30 must necessarily go into the opening at the top of the sleeve 31 and down through the sleeve to the mounting hole 30. Note that FIG. 2 is a cutaway that only shows the sides 31 of the sleeve, but it is understood that the sleeve itself is an enclosed cylindrical segment open at both ends. It will also be evident to those skilled in the art that a sleeve having a rectangular rather a cylindrical construction would also achieve the purposes of the invention. Nor is it necessary that the sleeve be vertically aligned, or that the sides of the sleeve be straight. It is only necessary that the sleeve be topologically equivalent to the cylindrical sleeve shown in FIG. 2. Various topologically equivalent structures will readily appear to those skilled in the art, which could be used to increase the creepage distance. However, the simple vertically aligned cylindrical sleeve is the best most of implementation from a practical manufacturing point of view.

In this way the invention provides a structure and means for increasing the creepage distance without incurring the disadvantages of the prior art approaches illustrated in FIGS. 1*b* and 1*c*. The invention has a further advantage in that, by adjusting the sleeve height 29 a range of creepage distance requirements can be accommodated, without altering the placement of the housing 21 upon the circuit board 28, thereby extending manufacturing economies. This sleeved case can be built with different sleeve lengths to meet different safety distance requirements, but the design also allows for production efficiencies where a particular sleeve height meets minimum clearance requirements for a plurality of circuits. The sleeve itself may be a molded part of the case assembly, and may be in a variety of shapes. In the preferred embodiment, the sleeve is in the form of a hollow cylinder, but as indicated above any topologically equivalent structure (such as a hollow rectangular bar) which completely surrounds the hole will work.

It should further be noted that the measurement of creepage distance begins at that point 23 where the core 22 most closely touches the casing 21. If the core 22 were not seated firmly in the casing with adequate clearance from other points of possible contact with the casing, the manufacturing process would not be able to achieve a desirable consistency in creepage distance, possibly leading to a reduced manufacturing yield. Consequently, in the best mode of implementation of the invention, the core is firmly seated by suitable means so that a selected point, chosen to meet creepage distance requirements, is the point where the core most closely touches the casing. Suitable means include adhesive at the point of contact 23. Also, suitably firm seating may be achieved by use of a potting material to fill the casing, after the core has been placed as desired within the casing.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. An apparatus suitable for automatic insertion of toroidal inductors onto circuit boards, comprising:

a case having one or more holes in a floor of said case;

a sleeve around at least one of said holes, said sleeve protruding up into said case a variable height above said floor;

a toroidal inductor mounted in said case and having a secondary coil, said secondary coil having electrical leads for connection to said circuit board, at least one of said leads being routed down through said sleeved hole, said toroidal inductor having a creepage distance and being subject to a creepage clearance limit for safe operation on said circuit board, said creepage distance increasing with increases in said sleeve height, wherein said variable sleeve height is set at least high enough so that said creepage distance meets or exceeds said creepage clearance limit.

2. The apparatus of claim 1, wherein at least one sleeve is a molded part of the casing.

3. The apparatus of claim 1, wherein at least one sleeve is in the form of a hollow cylinder.

4. The apparatus of claim 1, wherein at least one sleeve is in the form of a hollow rectangular bar.

5. The apparatus of claim 1, wherein said toroidal inductor is secured in said case by potting material.

6. The apparatus of claim 1, wherein said case floor is in the form of rectangle.

7. The apparatus of claim 1, wherein said toroidal inductor is secured to said case floor by an adhesive.

8. The apparatus of claim 1, wherein said toroidal inductor is secured within said case by means of a potting compound.

* * * * *